US007474304B2

(12) United States Patent
Lee et al.

(10) Patent No.: US 7,474,304 B2
(45) Date of Patent: Jan. 6, 2009

(54) DRIVING VOLTAGE GENERATING CIRCUIT AND DISPLAY DEVICE INCLUDING THE SAME

(75) Inventors: Jun-Pyo Lee, Gyeonggi-do (KR); Yun-Jae Park, Gyeonggi-do (KR); Seung-Hwan Moon, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 728 days.

(21) Appl. No.: 11/186,202

(22) Filed: Jul. 20, 2005

(65) Prior Publication Data

US 2006/0071926 A1 Apr. 6, 2006

(30) Foreign Application Priority Data

Oct. 1, 2004 (KR) ..... 10-2004-0078280

(51) Int. Cl.
*G09G 5/00* (2006.01)

(52) U.S. Cl. ..... 345/204; 345/211; 345/212

(58) Field of Classification Search ..... 345/204, 345/211–212
See application file for complete search history.

(56) References Cited

U.S. PATENT DOCUMENTS

| | | | | |
|---|---|---|---|---|
| 5,841,648 | A | 11/1998 | Mansfield | |
| 5,986,649 | A | 11/1999 | Yamazaki | |
| 6,434,027 | B1 * | 8/2002 | Sano et al. | 363/21.16 |
| 6,992,475 | B2 * | 1/2006 | Perner | 324/158.1 |
| 7,050,539 | B2 * | 5/2006 | Loef et al. | 378/105 |

FOREIGN PATENT DOCUMENTS

| | | |
|---|---|---|
| JP | 2000-236658 | 8/2000 |
| JP | 2002-262547 | 9/2002 |
| JP | 2004-40846 | 2/2004 |
| KR | 2002-0093015 | 12/2002 |
| KR | 10-0377698 | 3/2003 |
| KR | 2003-0073070 | 9/2003 |
| KR | 10-0421873 | 2/2004 |
| KR | 10-2004-0052356 | 6/2004 |
| KR | 10-2004-0063788 | 7/2004 |

OTHER PUBLICATIONS

Patent Abstracts of Japan, Publication No. 2000-236658, Aug. 29, 2000, 1 p.
Patent Abstracts of Japan, Publication No. 2002-262547, Sep. 13, 2002, 1 p.

(Continued)

*Primary Examiner*—Richard Hjerpe
*Assistant Examiner*—Leonid Shapiro
(74) *Attorney, Agent, or Firm*—MacPherson Kwok Chen & Heid LLP

(57) ABSTRACT

A driving voltage generating circuit includes: a pulse voltage generating unit generating predetermined pulse voltages; a first voltage generating unit connected to the pulse voltage generating unit and generating a first voltage; a first diode unit and a second diode unit commonly connected to the pulse voltage generating unit and each comprising at least a diode; a second voltage generating unit connected to the first diode unit and generating a second voltage; and a third voltage generating unit connected to the second diode unit and generating a third voltage.

17 Claims, 4 Drawing Sheets

OTHER PUBLICATIONS

Patent Abstracts of Japan, Publication No. 2004-040846, Feb. 5, 2004, 1 p.

English Language Abstract, Publication No. WO02061930 (corresponding to KR 2002-0093015, Dec. 12, 2002), 1 p.

Korean Patent Abstracts, Publication No. 100377698, Mar. 13, 2003, 1 p.

Korean Patent Abstracts, Publication No. 1020030073070, Sep. 19, 2003, 1 p.

Korean Patent Abstracts, Publication No. 100421873, Feb. 25, 2004, 1 p.

Korean Patent Abstracts, Publication No. 1020040052356, Jun. 23, 2004, 1 p.

English Language Abstract, Publication No. WO03049264 (corresponding to KR 2004-0063788, Jul. 14, 2004), 2 pp.

* cited by examiner

DRIVING VOLTAGE GENERATING CIRCUIT AND DISPLAY DEVICE INCLUDING THE SAME

BACKGROUND OF THE INVENTION (a) Field of the Invention

The present invention relates to a driving voltage generating circuit and a display device including the same.

(b) Description of Related Art

In recent times, flat panel displays such as organic light emitting diode ("OLED") displays, plasma display panels ("PDPs"), and liquid crystal displays ("LCDs") have been widely developed to replace the heavy and large cathode ray tubes ("CRTs").

The PDPs are devices which display characters or images using plasma generated by a gas-discharge. The OLED displays are devices which display characters or images by applying an electric field to specific light-emitting organics or high molecule materials. The LCDs are devices which display images by applying an electric field to a liquid crystal layer disposed between two panels and regulating the strength of the electric field to adjust a transmittance of light passing through the liquid crystal layer.

Among the flat panel displays, as examples, the LCD and the OLED display each includes a panel assembly provided with pixels including switching elements and display signal lines, a driving voltage generator generating driving voltages, a gate driver providing a gate signal for gate lines of the display signal lines to turn on/off the switching elements, a gray voltage generator generating a plurality of gray voltages, a data driver providing a data signal for data lines of the display signal lines to apply a data voltage to the pixel via the turned-on switching elements, and a signal controller controlling the above-described elements.

The above-described elements are applied with predetermined voltages to be converted into voltages required for driving the specific circuitry. For example, the gate driver is applied with a gate on voltage and a gate off voltage from the driving voltage generator for application to the gate lines as the gate signals, and the gray voltage generator is applied with a predetermined reference voltage from the driving voltage generator for dividing into a plurality of voltages via resistors and then providing the divided voltages for the data driver.

However, the gate-on voltage and the gate-off voltage are not generated independently of the reference voltage applied to the gray voltage generator, and thus accurate gate signals required for driving may not be supplied for the gate driver.

SUMMARY OF THE INVENTION

An object of the present invention is to provide a driving voltage generating circuit and a display device including the same that is capable of solving such a conventional problem.

A driving voltage generating circuit is provided, which includes:

a pulse voltage generating unit generating predetermined pulse voltages; a first voltage generating unit connected to the pulse voltage generating unit and generating a first voltage; a first diode unit and a second diode unit commonly connected to the pulse voltage generating unit and each comprising at least one diode; a second voltage generating unit connected to the first diode unit and generating a second voltage; and a third voltage generating unit connected to the second diode unit and generating a third voltage.

The first and the second diode units may each include at least two diodes connected in parallel to each other in a forward direction and in a backward direction.

The second and the third voltage generating units may each include at least one charge pump circuit.

The charge pump circuit may include two diodes and two capacitors.

The pulse voltage may have a high level and a low level, and the first voltage generating unit may generate a voltage substantially identical to the high level of the pulse voltage.

The first diode unit may include: a first node connected to the pulse voltage generating unit; a second node connected to the second voltage generating unit; first and second diodes connected in a first direction between the first and the second nodes; and third and fourth diodes connected in parallel with the first and the second diodes and connected in a second direction opposite to the first direction.

The second diode unit may include: a third node connected to the third voltage generating unit; a fifth diode connected in the first direction between the first node and the third node; and a sixth diode connected in parallel with the fifth diode and connected in the second direction.

The second voltage generating unit may include first and second charge pump circuits, wherein the first charge pump circuit may include: a fourth node connected to the first voltage via a seventh diode; a first capacitor connected between the fourth node and the second node; a fifth node connected to the fourth node via an eighth diode; and a second capacitor connected between the fifth node and a ground voltage. The second charge pump circuit may include: a sixth node connected to the fifth node via a ninth diode; a third capacitor connected between the sixth node and the second node; a first output terminal outputting the second voltage and connected to the sixth node via a tenth diode; and a fourth capacitor connected between the first output terminal and a ground voltage.

The third voltage generating unit may include a third charge pump circuit, wherein the third charge pump circuit may include: a seventh node connected to a ground voltage via an eleventh diode; a fifth capacitor connected between the third node and the seventh node; a second output terminal outputting the third voltage and connected to the seventh node via a twelfth diode; and a sixth capacitor connected between the second output terminal and a ground voltage.

The first voltage generating unit may include a third output terminal outputting the first voltage and connected to the first node via a thirteenth diode; and seventh to ninth capacitors connected in parallel between the third output terminal and a ground voltage.

The second voltage preferably satisfies the following equation:

$$V2=[(Vsw\times(1+Ncp))-(2\times Ncp\times Vth)]-(2\times Vth\times Nd\times Ncp)$$

where V2 is the second voltage, Vsw is a magnitude of the pulse voltage, Ncp is the number of charge pump circuits belonging to the second voltage generating unit, Vth is a threshold voltage of the diode, and Nd is the number of diodes comprised in the first diode unit and disposed in either the first direction or the second direction.

The third voltage preferably satisfies the following equation:

$$V3=-[((Vsw\times Ncp)-(2\times Ncp\times Vth))-(2\times Vth\times Nd\times Ncp)]$$

where V3 is the third voltage, Vsw is a magnitude of the pulse voltage, Ncp is the number of charge pump circuits belonging to the third voltage generating unit, Vth is a threshold voltage of the diode, and Nd is the number of diodes comprised in the second diode unit and disposed in either the first direction or the second direction.

A display device including a driving voltage generator generating first to third voltages, a gray voltage generator generating a plurality of gray voltages on the basis of the first voltage, and a gate driver generating a gate signal on the basis of the second and the third voltages, is provided, wherein the driving voltage generator includes: a pulse voltage generating unit generating predetermined pulse voltages; a first voltage generating unit connected to the pulse voltage generating unit and generating the first voltage; first and second diode units commonly connected to the pulse voltage generator and each comprising at least one diode; a second voltage generating unit connected to the first diode unit and generating the second voltage; and a third voltage generating unit connected to the second diode unit and generating the third voltage.

The first and the second diode units may each include at least two diodes connected in parallel to each other in a forward direction and in a backward direction.

The second and the third voltage generating units may each include at least one charge pump circuit.

The charge pump circuit may include two diodes and two capacitors.

The display device may further include a plurality of pixels arranged in a matrix, each of the pixels comprising a switching element, wherein the second voltage may be for turning on the switching element and the third voltage may be for turning off the switching element.

BRIEF DESCRIPTION OF THE DRAWINGS

The present invention will become more apparent by describing preferred embodiments thereof in detail with reference to the accompanying drawings, in which.

DETAILED DESCRIPTION OF EMBODIMENTS

Figure 1:
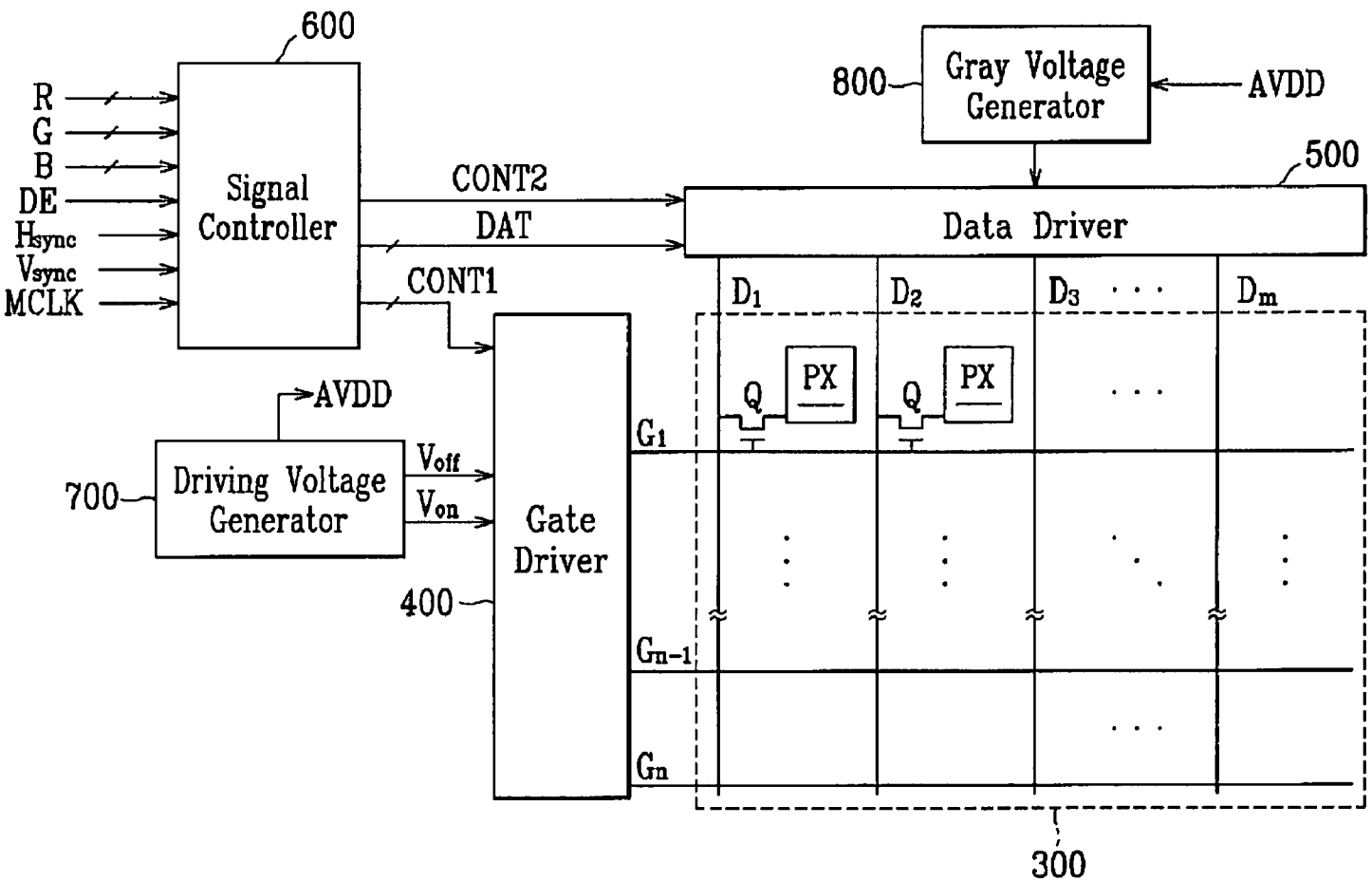
FIG. 1 is a block diagram of a display device according to an exemplary embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, film, region, substrate, or panel is referred to as being "on" another element, it can be directly on the other element or intervening elements may also be present. In contrast, when an element is referred to as being "directly on" another element, there are no intervening elements present.

A display device according to embodiments of the present invention will now be described with reference to the drawings.

Figure 2:
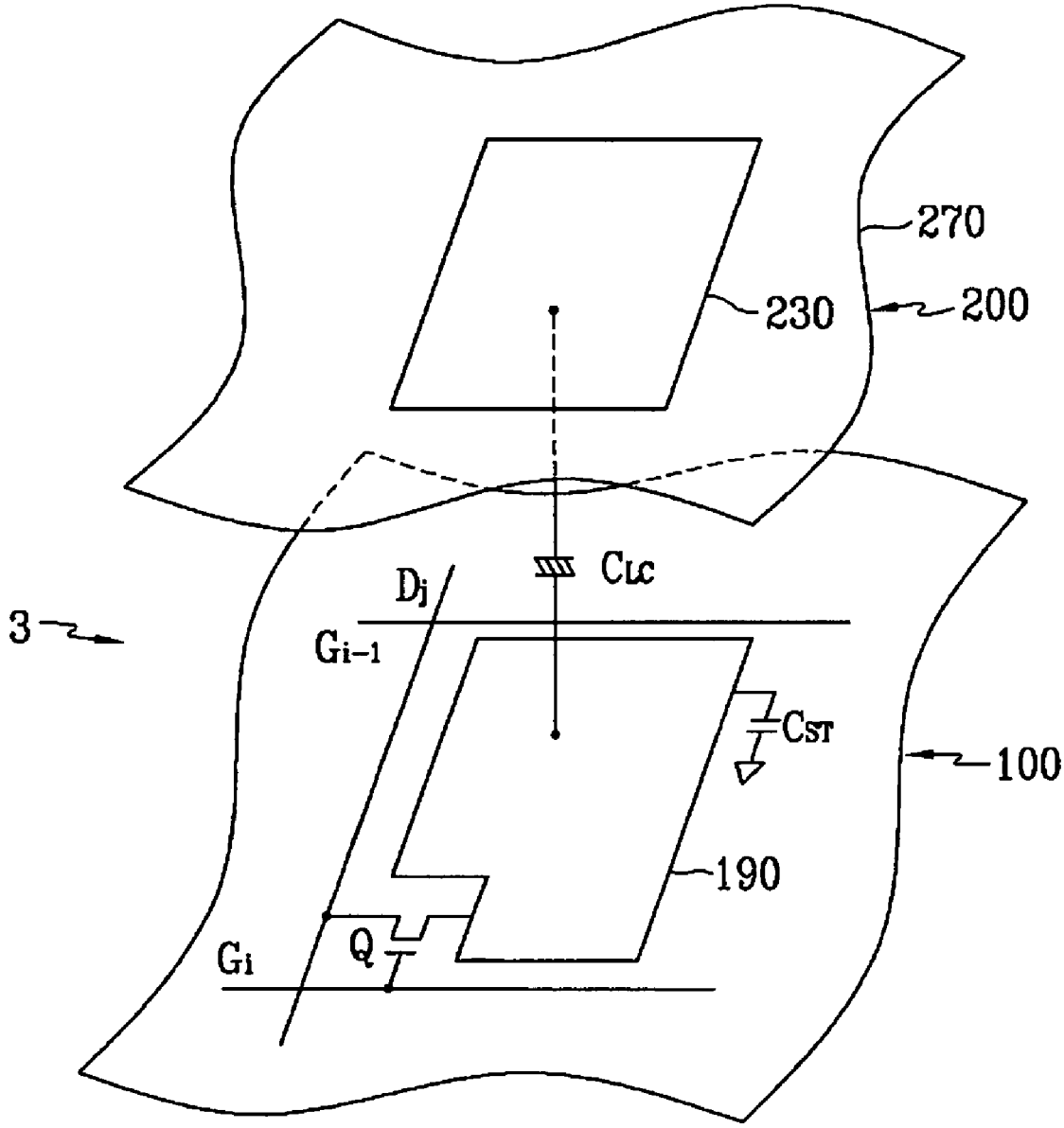
FIG. 2 illustrates a structure and an equivalent circuit diagram of a pixel of a liquid crystal display (LCD) according to an exemplary embodiment of the present invention.

FIG. 1 is a block diagram of a display device according to an embodiment of the present invention, and FIG. 2 illustrates a structure and an equivalent circuit diagram of a pixel of an LCD according to an exemplary embodiment of the present invention.

Referring to FIG. 1, a display device according to an exemplary embodiment of the present invention includes a panel assembly 300, a gate driver 400 and a data driver 500 connected thereto, a gray voltage generator 800 connected to the data driver 500, a driving voltage generator 700, and a signal controller 600 controlling the above-described elements.

The panel assembly 300 includes a plurality of display signal lines $G_1$-$G_n$ and $D_1$-$D_m$ and a plurality of pixels connected to the display signal lines $G_1$-$G_n$ and $D_1$-$D_m$ and arranged substantially in a matrix structure. The panel assembly 300 includes a lower panel 100 and an upper panel 200.

The display signal lines $G_1$-$G_n$ and $D_1$-$D_m$ are provided on the lower panel 100 and include gate lines $G_1$-$G_n$ transmitting gate signals (called scanning signals) and data lines $D_1$-$D_m$ transmitting data signals. The gate lines $G_1$-$G_n$ extend substantially in a row direction and are substantially parallel to each other, while the data lines $D_1$-$D_m$ extend substantially in a column direction and are substantially parallel to each other.

Each pixel includes a switching element Q connected to one of the gate lines $G_1$-$G_n$ and one of the data lines $D_1$-$D_m$, and pixel circuits PX connected to the switching element Q. The switching element Q is provided on the lower panel 100 and has three terminals: a control terminal connected to one of the gate lines $G_1$-$G_n$; an input terminal connected to one of the data lines $D_1$-$D_m$; and an output terminal connected to the pixel circuit PX.

In active matrix LCDs, which are an example of a flat panel display device, the panel assembly 300 includes the lower panel 100, the upper panel 200, a liquid crystal (LC) layer 3 disposed between the lower and upper panels 100 and 200, and the display signal lines $G_1$-$G_n$ and $D_1$-$D_m$ and the switching elements Q are provided on the lower panel 100. Each pixel circuit PX includes an LC capacitor $C_{LC}$ and a storage capacitor $C_{ST}$ that are connected in parallel with the switching element Q. The storage capacitor $C_{ST}$ may be omitted if the storage capacitor $C_{ST}$ is not needed.

The LC capacitor $C_{LC}$ includes a pixel electrode 190 on the lower panel 100, a common electrode 270 on the upper panel 200, and the LC layer 3 as a dielectric between the pixel and common electrodes 190 and 270. The pixel electrode 190 is connected to the switching element Q, and the common electrode 270 covers the entire surface of the upper panel 200 and is supplied with a common voltage Vcom. Alternatively, both the pixel electrode 190 and the common electrode 270, which have shapes of bars or stripes, are provided on the lower panel 100.

The storage capacitor $C_{ST}$ is an auxiliary capacitor for the LC capacitor $C_{LC}$. The storage capacitor $C_{ST}$ includes the pixel electrode 190, and a separate signal line (not shown) which is provided on the lower panel 100 and overlaps the pixel electrode 190 with an insulator disposed between the pixel electrode 190 and the separate signal line. The storage capacitor $C_{ST}$ is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 with an insulator disposed between the pixel electrode 190 and the previous gate line.

For a color display, each pixel uniquely represents one of three primary colors such as red, green, and blue colors (spatial division) or sequentially represents the three primary colors in time (temporal division), thereby obtaining a desired color. FIG. 2 shows an example of the spatial division in which each pixel includes a color filter 230 representing one of the three primary colors in an area of the upper panel 200 facing the pixel electrode 190. Alternatively, the color filter 230 is provided on or under the pixel electrode 190 on the lower panel 100.

A pair of polarizers (not shown) for polarizing light are attached on outer surfaces of the lower and upper panels 100 and 200 of the panel assembly 300.

Referring back to FIG. 1, the driving voltage generator 700 generates a reference voltage AVDD, a gate-on voltage Von, and a gate-off voltage Voff, and supplies the reference voltage AVDD to the gray voltage generator 800 and the gate-on voltage Von and the gate-off voltage Voff to the gate driver 400.

The gray voltage generator 800 generates one set or two sets of gray voltages related to transmittance of the pixels on the basis of the reference voltage AVDD from the driving voltage generator 800. When two sets of the gray voltages are generated, the gray voltages in one set have a positive polarity with respect to the common voltage Vcom, while the gray voltages in the other set have a negative polarity with respect to the common voltage Vcom.

The gate driver 400 synthesizes the gate-on voltage Von and the gate-off voltage Voff from the driving voltage generator 700 to generate gate signals for application to the gate lines $G_1$-$G_n$. The gate driver is a shift register, which includes a plurality of stages in a line.

The data driver 500 is connected to the data lines $D_1$-$D_m$ of the panel assembly 300 and applies data voltages selected from the gray voltages supplied from the gray voltage generator 800 to the data lines $D_1$-$D_m$.

The signal controller 600 controls the gate driver 400 and the data driver 500.

Now, the operation of the display device will be described in detail referring to FIG. 1.

The signal controller 600 is supplied with image signals R, G, and B and input control signals controlling the display of the image signals R, G, and B. The input control signals include, for example, a vertical synchronization signal Vsync, a horizontal synchronization signal Hsync, a main clock MCLK, and a data enable signal DE, from an external graphic controller (not shown). After generating gate control signals CONT1 and data control signals CONT2 and processing the image signals R, G, and B to be suitable for the operation of the panel assembly 300 in response to the input control signals, the signal controller 600 provides the gate control signals CONT1 to the gate driver 400, and the processed image signals DAT and the data control signals CONT2 to the data driver 500.

The gate control signals CONT1 include a vertical synchronization start signal STV for informing the gate driver of a start of a frame, a gate clock signal CPV for controlling an output time of the gate-on voltage Von, and an output enable signal OE for defining a width of the gate-on voltage Von.

The data control signals CONT2 include a horizontal synchronization start signal STH for informing the data driver 500 of a start of a horizontal period, a load signal LOAD or TP for instructing the data driver 500 to apply the appropriate data voltages to the data lines $D_1$-$D_m$, and a data clock signal HCLK. The data control signals CONT2 may further include an inversion control signal RVS for reversing the polarity of the data voltages (with respect to the common voltage Vcom).

The data driver 500 receives the processed image signals DAT for a pixel row from the signal controller 600 and converts the processed image signals DAT into the analogue data voltages selected from the gray voltages supplied from the gray voltage generator 800 in response to the data control signals CONT2 from the signal controller 600.

Responsive to the gate control signals CONT1 from the signal controller 600, the gate driver 400 applies the gate-on voltage Von to the gate lines $G_1$-$G_n$, thereby turning on the switching elements Q connected to the gate lines $G_1$-$G_n$.

The data driver 500 applies the data voltages to corresponding data lines $D_1$-$D_m$ for a turn-on time of the switching elements Q (which is called "one horizontal period" or "1H" and equals one period of the horizontal synchronization signal Hsync, the data enable signal DE, and the gate clock signal CPV). The data voltages in turn are supplied to corresponding pixels via the turned-on switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on a magnitude of the pixel voltage and the orientations determine a polarization of light passing through the LC capacitor $C_{LC}$. The polarizers convert light polarization into light transmittance.

By repeating the above-described procedure, all gate lines $G_1$-$G_n$ are sequentially supplied with the gate-on voltage Von during a frame, thereby applying the data voltages to all pixels. In the case of the LCD shown in FIG. 1, when a next frame starts after finishing one frame, the inversion control signal RVS applied to the data driver 500 is controlled such that a polarity of the data voltages is reversed ("frame inversion"). The inversion control signal RVS may be controlled such that the polarity of the data voltages flowing in a data line in one frame are reversed (e.g.: "row inversion", "dot inversion"), or the polarity of the data voltages in one packet are reversed (e.g., "column inversion", "dot inversion").

Now, a driving voltage generator for a display device according to an exemplary embodiment of the present invention will be described in detail with reference to FIGS. 3-5.

Figure 3:
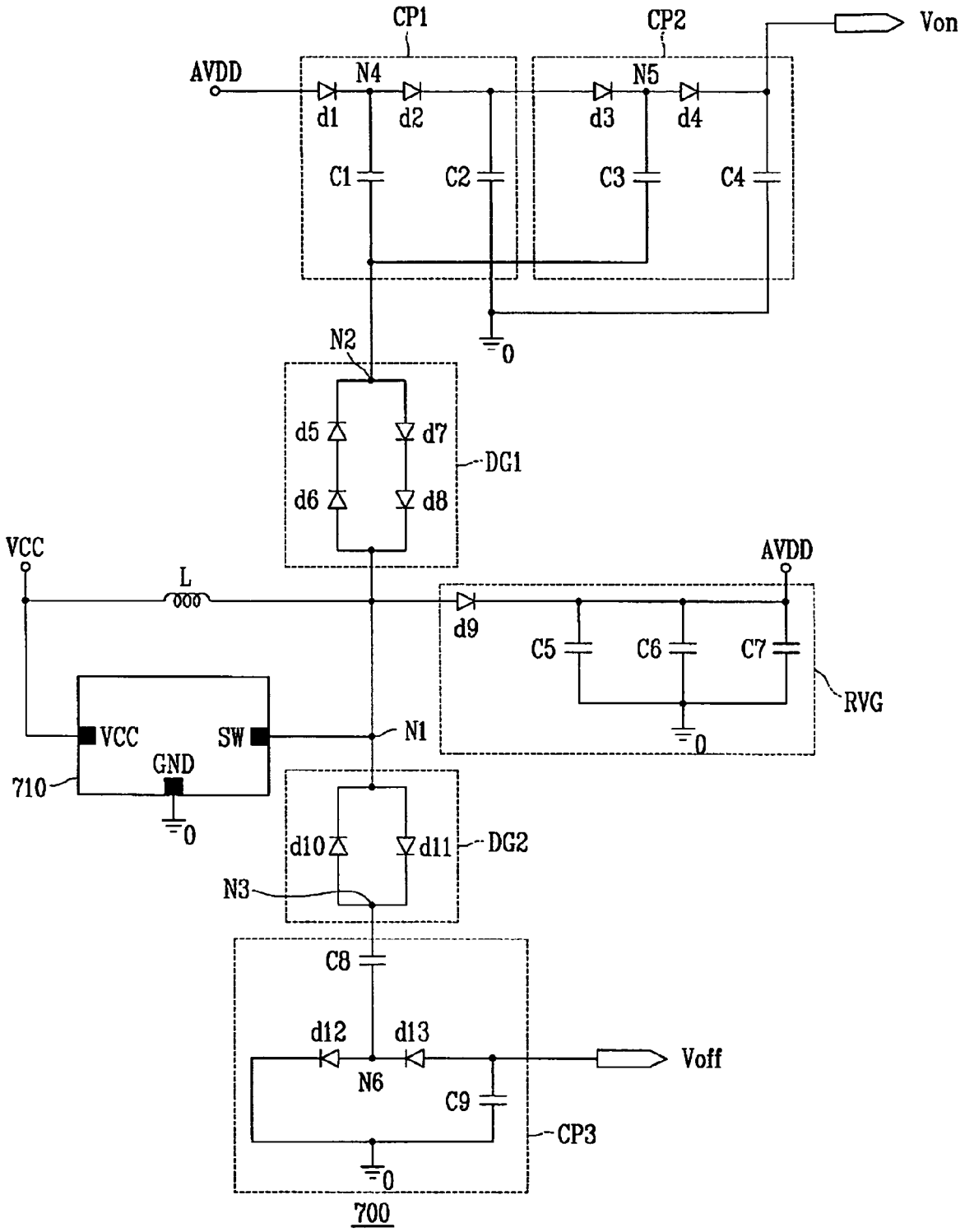
FIG. 3 is a circuit diagram of a driving voltage generating circuit according to an exemplary embodiment of the present invention.
Figure 4:
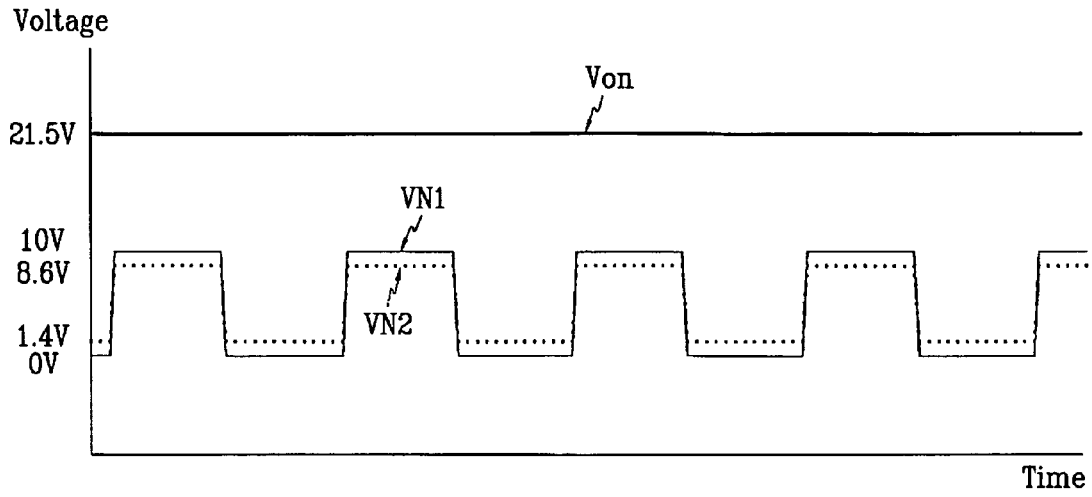
FIGS. 4 and 5 are waveforms of node voltages and a gate-on voltage and a gate-off voltage shown in FIG. 3.
Figure 5:
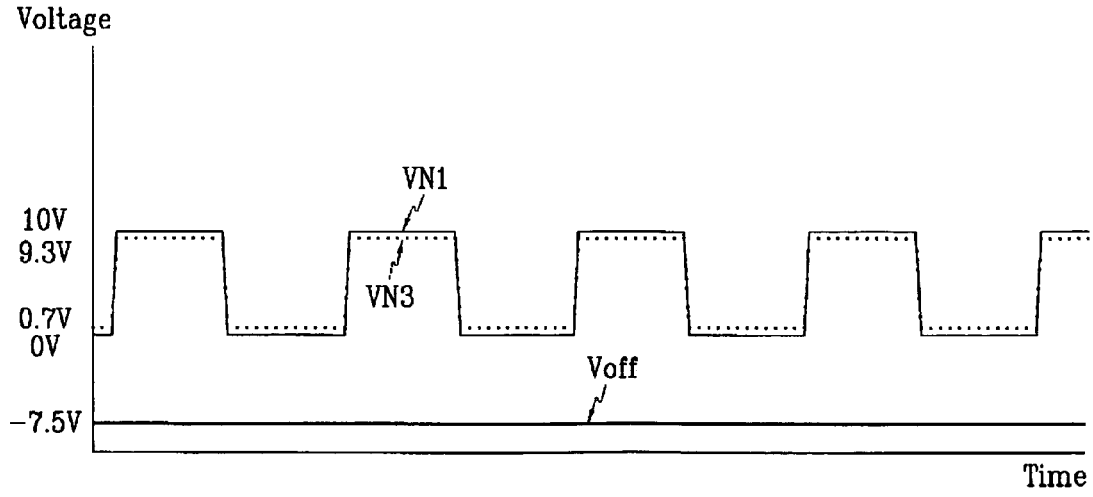

FIG. 3 is a circuit diagram of a driving voltage generating circuit according to an exemplary embodiment of the present invention, and FIGS. 4 and 5 are waveforms of node voltages and a gate-on voltage and a gate-off voltage shown in FIG. 3. The waveforms are obtained by SPICE simulation of the circuit in FIG. 3.

Referring to FIGS. 3-5, the driving voltage generator 700 according to an exemplary embodiment of the present invention includes a pulse generating unit 710, a plurality of diode units DG1 and DG2 and a reference voltage generating unit RVG connected in parallel to the pulse generating unit 710, and a plurality of charge pump circuits CP1-CP3 connected to each of the diode units DG1 and DG2.

The pulse generating unit 710 is typically comprised of an integrated circuit (IC), and is applied with a predetermined voltage VCC such as 3.3V to generate a periodic function having a magnitude of 10V as shown in FIGS. 4 and 5.

The diode unit DG1 includes two pairs of diodes d5-d8 connected in parallel between a node N1 and a node N2 and disposed in a forward and a backward direction, and the diode unit DG2 includes a pair of diodes d10 and d11 connected in parallel between the node N1 and a node N3 and disposed in a forward and a backward direction.

Each of the charge pump circuits CP1-CP3 includes two diodes and two capacitors.

That is, the charge pump circuit CP1 includes two diodes d1 and d2 and two capacitors C1 and C2, the charge pump circuit CP2 includes two diodes d3 and d4 and two capacitors C3 and C4, and the charge pump circuit CP3 includes two diodes d12 and d13 and two capacitors C8 and C9.

One end of the capacitor C1 is connected to a point of contact between two diodes d1 and d2 and the other end thereof is connected to the node N2, and one end of the capacitor C2 is connected to a point of contact between two diodes d2 and d3 and the other end thereof is connected to a ground voltage. Likewise, one end of the capacitor C3 is connected to a point of contact between two diodes d3 and d4 and the other end thereof is connected to the node N2, and one end of the capacitor C4 is connected to a gate-on voltage output terminal and the other end thereof is connected to the ground voltage. Additionally, one end of the capacitor C8 is connected to the node N3 and the other end thereof is connected a point of contact between two diodes d12 and d13, and one end of the capacitor C9 is connected to a gate-off voltage output terminal Voff and the other end thereof is connected to the ground voltage.

The reference voltage generating unit RVG includes three capacitors C5-C7 commonly connected to the node N1 via the diode d9.

An inductor L connected between the predetermined voltage VCC and the node N1 prevents currents from varying rapidly.

Now, an operation of the driving voltage generator 700 having such configuration will be described. In this case, a gate-on voltage and a gate-off voltage used for a display device, especially an LCD, are 22V and −7.5V, respectively, and values similar thereto as an example will be described.

First, a process of generating the gate-on voltage Von will be described.

Hereinafter, it is assumed that each of the diodes d1-d13 has a threshold voltage of 0.7V.

When the pulse generating unit 710 applies 0V to the node N1, the reference voltage generating unit RVG generates a reference voltage AVDD of 0V and the reference voltage AVDD is connected to an anode terminal of the diode d1 of the charge pump circuit CP1.

A voltage at the node N1, i.e., the node voltage VN1 is 0V, and then a voltage at the node N2, i.e., the node voltage VN2 is 1.4V passed through two diodes d7 and d8 disposed in a backward direction.

Meanwhile, a voltage at a node N4 between two diodes d1 and d2 is 0V as well, and a voltage over the capacitor C1 is −1.4V with respect to the node N4.

Subsequently, a voltage of 10V is applied to the node N1, and then the node voltage VN2 is changed to 8.6V due to a forward current, and thus a voltage at the node N4 becomes 7.2V which is the sum of the voltage over the capacitor C1 and the node voltage VN2. The reference voltage AVDD from the reference voltage generating unit RVG is also 10V, which is changed to 9.3V due to a voltage drop of 0.7V passing through the diode d1, and then a final voltage at the node N2 becomes 16.5V by adding 9.3V to 7.2V. In this case, it is assumed that there is no voltage drop across diode d9 between the reference voltage AVDD and the node N1 for calculative convenience. The diode d9 has a smaller threshold voltage than the other diodes d1-d8 and d10-d13 so that the reference voltage AVDD may be closer to the pulse voltage generated from the pulse generating unit 710. For example, the threshold voltage of the diode d9 ranges from 0.2V to 0.3V, and an accurate value may be obtained by subtracting the value from a calculated final value.

Additionally, a voltage over the capacitor C2 becomes 15.8V due to a voltage drop of 0.7V when passing through the diode d2, and a voltage at one end of the capacitor C3, i.e., a voltage at a node N5, becomes 15.1V when passing through the diode d3 once more.

Then, application of 0V to the node N1 changes a voltage at node N2 to 1.4V, and a voltage over the capacitor C3 becomes 13.7V which is a difference of the voltage at the node N5 and the voltage at the node N2.

Next, when the node voltage VN2 becomes 8.6V, a voltage at the node N5 becomes 22.3V which is the sum of 8.6V and 13.7V corresponding to a voltage over the capacitor C3. The voltage at the node N5 passes through the diode d4 to be 21.6V which is a gate-on voltage.

Thereafter, the diode d4 turns on only when an anode terminal of the diode d4 has a voltage at the node N5 that is higher than the gate-on voltage and the diode turns off when a cathode terminal thereof, i.e., the gate-on voltage output terminal Von, has a higher voltage than the anode terminal, and thus the capacitor C4 maintains a floating state. Accordingly, the gate-on voltage output terminal Von outputs a voltage of 21.6V continuously. The result of the simulation in FIG. 4 is similar to the embodiment of the present invention where the gate on voltage Von is 21.5V. Additionally, as described above, considering the voltage drop on the diode d9, the gate-on voltage Von becomes 21.3V or 21.4V.

Now, a process of generating a gate-off voltage will be described.

At first, when the node N1 is applied with 10V, a current flows through the diode d11, the capacitor C8, and the diode d12 to the ground. A voltage at the node N3, i.e., a node voltage VN3, becomes 9.3V and a voltage at a node N6 becomes 0.7V. At this time, a voltage over the capacitor C8 is 8.6V which is a difference of voltages at the nodes N3 and N6.

Subsequently, when the node voltage VN1 becomes 0V, a current flows in a reverse direction, that is, flows from the ground to the node N1 through the capacitor C9, the diode d13, the capacitor C8, and the diode d10. Thus, the node voltage VN3 is changed to 0.7V from 9.3V. The node voltage VN3 is the sum of a voltage over the capacitor C8 and a voltage at the node N6, and thus becomes −7.9V. Accordingly, a voltage at the gate-off voltage output terminal Voff becomes −7.2V which is the sum of the voltage at the node and the threshold voltage of 0.7V for the diode d13.

When the node voltage VN1 becomes 10V again, the diode d13 turns off to cause the capacitor C9 to be in a floating state, thereby outputting −7.2V continuously. Alternatively, when the node voltage VN1 becomes 0V, the gate-off voltage output terminal Voff outputs −7.2V by repeating the above-described procedure. The result of the simulation in FIG. 5 is similar to the embodiment of the present invention where the gate off voltage Voff is −7.5V.

In this way, the gate-on voltage Von and the gate-off voltage Voff are generated, and thus desired gate signals can be obtained regardless of the reference voltage AVDD.

Meanwhile, the above-described gate signals Von and Voff can be acquired simply using the following equations.

$$Von \approx \frac{[(Vsw \times (1 + Ncp)) - (2 \times Ncp \times Vth)]}{a} - \frac{(2 \times Vth \times Nd \times Ncp)}{b} \quad (1)$$

$$Voff \approx -\left[\frac{((Vsw \times Ncp) - (2 \times Ncp \times Vth))}{a} - \frac{(2 \times Vth \times Nd \times Ncp)}{b}\right] \quad (2)$$

where Vsw is a magnitude of a voltage generated from the pulse generating unit 710, Ncp is the number of the charge pump circuits, Vth is a threshold voltage of each of the diodes d1-d13, and Nd is the number of diodes comprised in the diode units DG1 and DG2.

For example, in the circuit diagram shown in FIG. 3, Ncp is 2 for the gate-on voltage generating and is 1 for the gate-off voltage generating, and each of the charge pump circuits CP1-CP3 includes two capacitors and two diodes. Additionally, Nd is not the number of all the diodes comprised in the diode units DG1 and DG2 but rather is the number of diodes disposed in either a forward or a backward direction, and, for example, Nd is 2 for the diode unit DG1 and 1 for the diode unit DG2.

In this case, for example, in generating the gate-on voltage, Vsw is 10V, Ncp is 2, Vth is 0.7V, and Nd is 2, and, substitution of these values for the equation 1 gives $$Von=[(10\times(1+2))-(2\times2\times0.7)]-(2\times0.7\times2\times2)=21.6V \quad (3)$$

This is a same result as the above-obtained value, and, the same applies to the gate-off voltage.

Meanwhile, the underlined portions (a) in the equations 1 and 2 are used to calculate a gate-on voltage and a gate-off voltage in the prior art in which the diode units DG1 and DG2 are not disposed between the node N1 and the node N2 and the node N1 and the node N3, respectively. In this case, the gate-on voltage is 27.2V and the gate-off voltage is −8.6V, and these are far from the desired values.

In accordance with the present invention, the diode units DG1 and DG2 are disposed between the charge pump circuits CP1-CP3 and the node N1 is applied with the pulse voltages, and thus desired voltages can be acquired regardless of the reference voltage AVDD.

Furthermore, the number of the charge pump circuits and the number of the diodes comprising the diode units are adjusted to generate desired voltages including the gate-on and the gate-off voltages.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A driving voltage generating circuit comprising:

a pulse voltage generating unit generating predetermined pulse voltages;

a first voltage generating unit connected to the pulse voltage generating unit and generating a first voltage;

a first diode unit and a second diode unit commonly connected to the pulse voltage generating unit and each comprising at least one diode;

a second voltage generating unit connected to the first diode unit and generating a second voltage; and a third voltage generating unit connected to the second diode unit and generating a third voltage.

2. The driving voltage generating circuit of claim 1, wherein the first and the second diode units each comprises at least two diodes connected in parallel to each other in a forward direction and in a backward direction.

3. The driving voltage generating circuit of claim 2, wherein the second and the third voltage generating units each comprises at least one charge pump circuit.

4. The driving voltage generating circuit of claim 3, wherein the charge pump circuit comprises two diodes and two capacitors.

5. The driving voltage generating circuit of claim 4, wherein the pulse voltage has a high level and a low level, and the first voltage generating unit generates a voltage substantially identical to the high level of the pulse voltage.

6. The driving voltage generating circuit of claim 1, wherein the first diode unit comprises:

a first node connected to the pulse voltage generating unit;

a second node connected to the second voltage generating unit;

first and second diodes connected in a first direction between the first and the second nodes; and third and fourth diodes connected in parallel with the first and the second diodes and connected in a second direction opposite to the first direction.

7. The driving voltage generating circuit of claim 6, wherein the second diode unit comprises:

a third node connected to the third voltage generating unit;

a fifth diode connected in the first direction between the first node and the third node; and a sixth diode connected in parallel with the fifth diode and connected in the second direction.

8. The driving voltage generating circuit of claim 7, wherein the second voltage generating unit comprises first and second charge pump circuits, wherein the first charge pump circuit comprises:

a fourth node connected to the first voltage via a seventh diode;

a first capacitor connected between the fourth node and the second node;

a fifth node connected to the fourth node via an eighth diode; and a second capacitor connected between the fifth node and a ground voltage, and wherein the second charge pump circuit comprises:

a sixth node connected to the fifth node via a ninth diode;

a third capacitor connected between the sixth node and the second node;

a first output terminal outputting the second voltage and connected to the sixth node via a tenth diode; and a fourth capacitor connected between the first output terminal and a ground voltage.

9. The driving voltage generating circuit of claim 8, wherein the third voltage generating unit comprises a third charge pump circuit, wherein the third charge pump circuit comprises:

a seventh node connected to a ground voltage via an eleventh diode;

a fifth capacitor connected between the third node and the seventh node;

a second output terminal outputting the third voltage and connected to the seventh node via a twelfth diode; and a sixth capacitor connected between the second output terminal and a ground voltage.

10. The driving voltage generating circuit of claim 9, wherein the first voltage generating unit comprises a third output terminal outputting the first voltage and connected to the first node via a thirteenth diode; and seventh to ninth capacitors connected in parallel between the third output terminal and a ground voltage.

11. The driving voltage generating circuit of claim 10, wherein the second voltage satisfies the following equation:

$$V2=[(Vsw\times(1+Ncp))-(2\times Ncp\times Vth)]-(2\times Vth\times Nd\times Ncp)$$

where V2 is the second voltage, Vsw is a magnitude of the pulse voltage, Ncp is the number of the charge pump circuits belonging to the second voltage generating unit, Vth is a threshold voltage of the diode, and Nd is the number of diodes comprising the first diode unit and disposed in either the first direction or the second direction.

12. The driving voltage generating circuit of claim 11, wherein the third voltage satisfies the following equation:

$$V3=-[((Vsw\times Ncp)-(2\times Ncp\times Vth))-(2\times Vth\times Nd\times Ncp)]$$

where V3 is the third voltage, Vsw is a magnitude of the pulse voltage, Ncp is the number of charge pump circuits belonging to the third voltage generating unit, Vth is a threshold voltage of the diode, and Nd is the number of diodes comprised in the second diode unit and disposed in either the first direction or the second direction.

13. A display device comprising a driving voltage generator generating first to third voltages, a gray voltage generator generating a plurality of gray voltages on the basis of the first voltage, and a gate driver generating a gate signal on the basis of the second and the third voltages, wherein the driving voltage generator comprises:

a pulse voltage generating unit generating predetermined pulse voltages;

a first voltage generating unit connected to the pulse voltage generating unit and generating the first voltage;

first and second diode units commonly connected to the pulse voltage generator and each comprising at least one diode;

a second voltage generating unit connected to the first diode unit and generating the second voltage; and a third voltage generating unit connected to the second diode unit and generating the third voltage.

14. The display device of claim 13, wherein the first and the second diode units each comprises at least two diodes connected in parallel to each other in a forward direction and in a backward direction.

15. The display device of claim 14, wherein the second and the third voltage generating units each comprises at least a charge pump circuit.

16. The display device of claim 15, wherein the charge pump circuit comprises two diodes and two capacitors.

17. The display device of claim 16 further comprising a plurality of pixels arranged in a matrix, each of the pixels comprising a switching element, wherein the second voltage is for turning on the switching element and the third voltage is for turning off the switching element.

* * * * *